United States Patent [19]

Spitzke

[11] 4,159,121

[45] Jun. 26, 1979

[54] ACCESSORIES FOR SKATEBOARDS

[75] Inventor: Arthur Spitzke, Troy, Mich.

[73] Assignee: Matrix Corporation, Troy, Mich.

[21] Appl. No.: 901,982

[22] Filed: May 1, 1978

[51] Int. Cl.[2] ..... A63C 17/00

[52] U.S. Cl. ..... 280/87.04 A

[58] Field of Search ..... 280/87.04 A, 87.04 R, 280/601, 11.3, 11.1 R, 11.1 BT, 607; 9/310 AA, 310 E; 272/57 E; 36/11.5

[56] References Cited

U.S. PATENT DOCUMENTS

| | | | |
|---|---|---|---|
| D. 200,864 | 4/1965 | de Roca | 280/87.04 A |
| 1,253,768 | 1/1918 | Aman | 280/87.04 R |
| 1,875,162 | 8/1932 | Sayers | 36/11.5 |
| 3,567,242 | 3/1971 | Miller | 280/87.04 R |
| 4,031,988 | 6/1977 | Hill | 280/87.04 A |
| 4,040,639 | 8/1977 | Scardenzan | 280/87.04 A |
| 4,055,234 | 10/1977 | Burton | 280/87.04 A |

FOREIGN PATENT DOCUMENTS 1075477 2/1960 Fed. Rep. of Germany ... 280/11.1 BT

OTHER PUBLICATIONS

"Aerial Freestyle Bindings", Go For It Sports, Skate Boarder Magazine, Aug. 1977, vol. 4, No. 1.

*Primary Examiner*—David M. Mitchell

*Attorney, Agent, or Firm*—Fisher, Gerhardt & Groh

[57] ABSTRACT

A grip accessory for skateboards, a pair of which are mounted on the top surface of the board to form foot or hand holds, each grip accessory being shaped generally like a mushroom with a stem and a head with the head spaced from the top surface of the skateboard to form an annular groove around the stem to receive the feet of a user of the board. The head also forms a hand rest for doing handstands.

8 Claims, 5 Drawing Figures

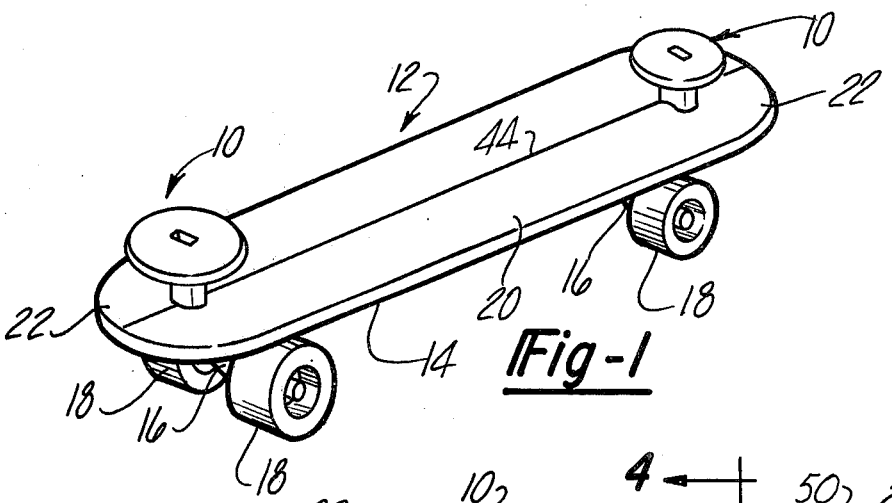
Fig-1
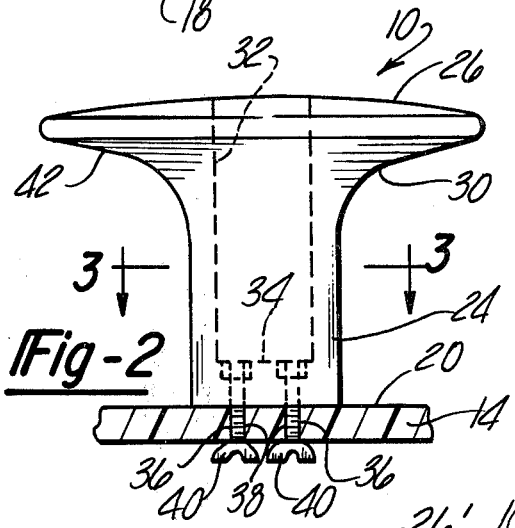
Fig-2
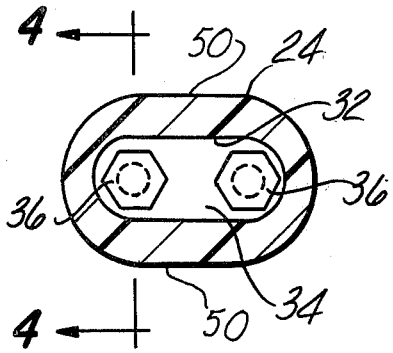
Fig-3
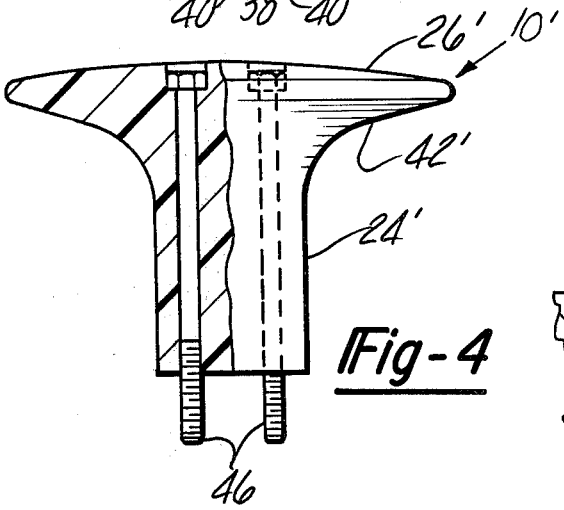
Fig-4
Fig-5
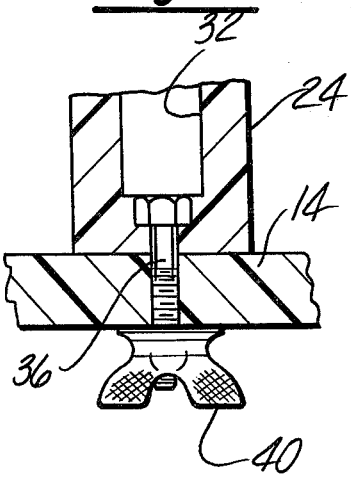

ACCESSORIES FOR SKATEBOARDS

This invention relates to land vehicles such as skateboards and more particularly to a grip accessory by which the skateboard may be held with either the feet or the hands of a user.

It is an object of the invention to provide a grip accessory for skateboards by which the feet may be firmly engaged with the board so that during jumping acrobatics the board can be maintained positively attached to the feet but at the same time is instantly releaseable.

Another object of the invention is to provide a girp accessory for skateboards which form grip portions elevated above the surface of the board to protect the hands.

The objects of this invention are accomplished by providing a grip accessory for skateboards a pair of which are detachably mounted in longitudinally spaced relationship on the upper surface of a skateboard, each accessory comprising a pedestal member acting to support a head member in an elevated position above the surface of the board. The head member and board surface form an annular groove around the pedestal member such that the shoes of an operator can be positioned under the head and against the pedestal member. Opposite feet of the operator are moved apart so that the outboard edges of the feet are engaged with the pair of grip accessories so that when the wheels of the skateboard leave the ground the skateboard stays with the operator unless the operator chooses to move his feet together in which case the feet of the operator become separated from the board. The pedestal member and head member are made as a unit from a suitable thermoplastic material and are fastened to the board by means of a pair of bolts which prevent turning of the grip accessory. The grip accessories also form hand holds by which the user of the skateboard may do handstands on the board. In one embodiment of the invention the pedestal member is made solid so that it can be cut and trimmed to determine the spacing of the head member from the top surface of the skateboard to accommodate different sizes of shoes.

These and other objects of the invention will be apparent from the following description and from the drawings in which:

FIG. 1 is a perspective view of a skateboard with grip accessories embodying the invention;

FIG. 2 is a side elevation of one of the grip accessories seen in FIG. 1 but at an enlarged scale;

FIG. 3 is a cross-sectional view at an enlarged scale taken on line 3—3 in FIG. 2;

FIG. 4 is a broken away cross-sectional view of a modification of the invention, and FIG. 5 is a cross sectional view taken on line 4—4 in FIG. 3.

Referring to the drawings, grip accessories embodying the present invention are designated generally at 10 and a pair of such accessories 10 are shown in association with a skateboard 12. The skateboard 12 includes a body member or board 14 the underside of which supports a pair of trucks 16 each of which has a pair of ground engaging wheels 18. The upper surface 20 of the board 14 is adapted to receive the feet of a user who rides the skateboard. Typically the upper surface 20 of the skateboard 14 is provided with a roughened or abrasive surface to insure firm placement and grip of the feet of the operator on the upper surface of the skateboard.

As best seen in FIG. 1 the board 14 is provided with a pair of grip accessories 10 one of which is supported adjacent each end 22 of the skateboard 12. As best seen in FIG. 2, each grip accessory 10 is generally mushroom shaped and includes a stem or pedestal 24 having a disc shaped head portion 26. The lower end 28 of the pedestal 24 is adapted to be connected to the top surface 20 of the board 14. The upper end of the pedestal 24 and head 26 merge at a fillet portion 30. Preferably the pedestal 24 and the head 26 are molded integrally of a suitable thermoplastic material to form a relatively rigid and yet soft plastic unit.

The pedestal 24 is generally elliptical or oval in cross-section as seen in FIG. 3 and is provided with a blind bore 32 having a similarly shaped cross-section. The bottom end or wall 34 of the bore 32 is adapted to receive a pair of bolts 36 in side by side relationship. The bolts 36 are intended to extend generally axially of the pedestal 24 and to pass through openings 38 in the board or body member 14. Wing nuts 40 are threadably engaged with the ends of the bolts 36 to grip the underside of the board 14 and to hold the grip accessory 10 in firm position on the upper surface of the board 14. The end wall 34 in the bore 32 is provided with hexagon shaped recesses which receive the heads of the bolts 36 and prevent their rotation when the wing nuts 40 are tightened on the bolts 36.

The upper surface of the head 26 is generally convex to form a comfortable pad surface 42 when the grip accessory 10 is held by the hand of an operator.

Installation of the grip accessory 10 is accomplished by marking the center line of the board 14 so that the line passes longitudinally of the board 14 and between the pairs of wheels 18. Openings 38 are then formed in the board to be disposed symmetrically at opposite sides of the center line indicated at 44. Thereafter the grip accessory 10 may be placed in position with the bolts 36 passing through the openings 38. The wing nuts 40 are placed in position and tightened to firmly maintain the grip accessory 10 in position. This forms a detachable connection so that the grip accessory 10 may be attached or detached as desired by the operator. To facilitate attachment and orientation of the pairs of bolts 36 or 46, the pedestal 24 has opposed flat surfaces 50 that act as guides which are located to extend transversely of the board 14.

A modified form of the invention is shown in FIG. 4 wherein a grip accessory 10' has a stem or pedestal 24' formed without a bore 32. In this form, bolts 46 extend from the head 26' the full length of the solid pedestal 24' and through the board 14. This makes it possible to cut off selected amounts from the bottom end of the pedestal 24' to establish the distance from the undersurface 42' of the head 26' to the top surface of the board 14 to fit the shoes of the user of the board. This distance is determined by the operator's preference relative to how tightly the grip accessory 10 is to fit relative to his shoes.

In operation the user of the skateboard can place his feet between the grip accessory 10 so that the outboard sides of the shoes are disposed in the annular grooves formed between the head 26 and the upper surface 20 of the board 14. Exertion of a slight amount of pressure outwardly to spread the feet maintains the board 14 firmly connected to the feet of the operator so that during aerial acrobatics such as jumping or curb hopping, the board remains attached to the feet. However, if the maneuver is to be aborted, the operator moves his feet towards each other and he becomes completely and instantly disengaged from the skateboard.

Because of the annular groove formed completely around the stem pedestal 24, the operator may position his feet in side by side relationship with respect to only one of the grip accessories. In that instance the inboard edges of the shoes of the operator are disposed at opposite sides of a single grip accessory. It will be appreciated also that the opposite forward portions of the grooves may be used for various operations such as flipping a board or the like.

In addition to foot engagement with the grip accessories 10 the upper surface 42 forms a pad so that the operator may grip the pair of grip accessories 10 in opposite hands and do handstands or other acrobatics.

A grip accessory for skateboards has been provided which is adapted to receive either the feet or hands of an operator in which each of the grip accessories is generally mushroom shaped in configuration and has a pedestal, the lower end of which is connected to the top surface of the skateboard and the other end of the pedestal is provided with a head portion such that a hand or foot receiving recesses is provided between the head and the board which extends continuously around the pedestal. The grip accessory may be used for firm and positive engagement with either the feet or hands of an operator of a skateboard.

The embodiments of the invention in which an exclusive property or privilege is claimed are defined as follows:

1. An accessory for skateboards having a board with an upper riding surface, said accessory comprising; a pedestal member having one end adapted for connection to said upper riding surface, a head member supported by said pedestal in elevated position above said board and projecting from opposed sides of said pedestal, said pedestal and head forming opposed shoe supporting portions engageable with a side of a shoe to support said skateboard on said shoe, and said head member forming a hand gripping portion.

2. The combination of claim 1 wherein said head member is generally disc-shaped extending radially from said pedestal to form a continuous groove around said pedestal to form said shoe supporting portions.

3. The combination of claim 1 and further comprising bolt means associated with said pedestal for detachably connecting said pedestal to said board.

4. The combination of claim 3 wherein an axially extended recess is formed in said pedestal member to extend to a point spaced from said one end to form a wall, said bolt means being seated in said wall.

5. The combination of claim 3 wherein said bolt means include a pair of bolts in side by side relationship to prevent turning of said pedestal member relative to said board.

6. The combination of claim 1 wherein said pedestal member has a pair of opposed flat surfaces facilitating orientation of said grip accessory relative to said board.

7. The combination of claim 1 wherein said accessory is mounted adjacent one end of said board.

8. A skateboard comprising an elongated board member supported on ground engaging wheels and having a generally flat riding surface, a pair of grip accessories mounted adjacent opposite ends of said board, each of said grip accessories including a pedestal member having one end adapted for connection to said upper riding surface of said board, a head member supported by said pedestal in elevated position above said board and projecting from opposed sides of said pedestal to form shoed foot receiving portions operative to hold said skateboard attached to shoes upon pressing feet in opposite directions relative to said pair of accessories and upon pressing feet toward each other at opposite sides and relative to a selected one of said accessories, said head members of said pair of grip accessories being disposed in substantially the same elevation above said riding surface.

* * * * *